United States Patent [19]

Sakamoto et al.

[11] Patent Number: 4,602,564

[45] Date of Patent: Jul. 29, 1986

[54] INKING DEVICE IN A PRINTING MACHINE

[75] Inventors: Yasumasa Sakamoto; Toyoo Nimoda; Yoshinori Hattori, all of Mihara, Japan

[73] Assignee: Mitsubishi Jukogyo Kabushiki Kaisha, Tokyo, Japan

[21] Appl. No.: 764,963

[22] Filed: Aug. 12, 1985

Related U.S. Application Data

[63] Continuation of Ser. No. 463,264, Feb. 2, 1983, abandoned.

[30] Foreign Application Priority Data

Apr. 22, 1982 [JP] Japan ..... 57-67966

[51] Int. Cl.[4] ..... B41F 31/00

[52] U.S. Cl. ..... 101/350; 101/363; 101/367

[58] Field of Search ..... 101/350, 349, 363, 351, 101/148, DIG. 14, 367

[56] References Cited

U.S. PATENT DOCUMENTS

| | | | |
|---|---|---|---|
| 2,127,455 | 8/1938 | Wood | 101/350 |
| 2,288,174 | 6/1942 | Wood et al. | 101/350 X |
| 2,363,817 | 11/1944 | Taylor | 101/350 |
| 2,986,088 | 5/1961 | Chase et al. | 101/350 |
| 3,182,632 | 5/1965 | Vazdikis | 101/350 X |
| 3,585,932 | 6/1971 | Granger | 101/350 |
| 3,587,463 | 6/1971 | Granger | 101/350 |
| 3,613,578 | 10/1971 | Heurich | 101/350 |
| 4,186,661 | 2/1980 | Vieau | 101/350 X |
| 4,237,785 | 12/1980 | Dahlgren | 101/350 X |
| 4,244,292 | 1/1981 | Williams et al. | 101/350 |

*Primary Examiner*—Edgar S. Burr
*Assistant Examiner*—Moshe I. Cohen
*Attorney, Agent, or Firm*—Wenderoth, Lind & Ponack

[57] ABSTRACT

An inking device in a printing machine is improved by providing an ink reciprocating roller adjacent to ink application rollers, a regulator provided adjacent to a hysteresis surface of the ink reciprocating roller for forming residual ink on the hysteresis surface into a uniform film thickness, an ink source roller partly immersed in ink in an ink receiver, and an ink delivery roller interposed between the ink source roller and the ink reciprocating roller.

1 Claim, 2 Drawing Figures

INKING DEVICE IN A PRINTING MACHINE

This application is a continuation, of now abandoned application Ser. No. 463,264, filed Feb. 2, 1983.

The present invention relates to an inking device in a printing machine, and which is applicable to a lithographic printing machine, a relief printing machine and the like.

Figure 1:
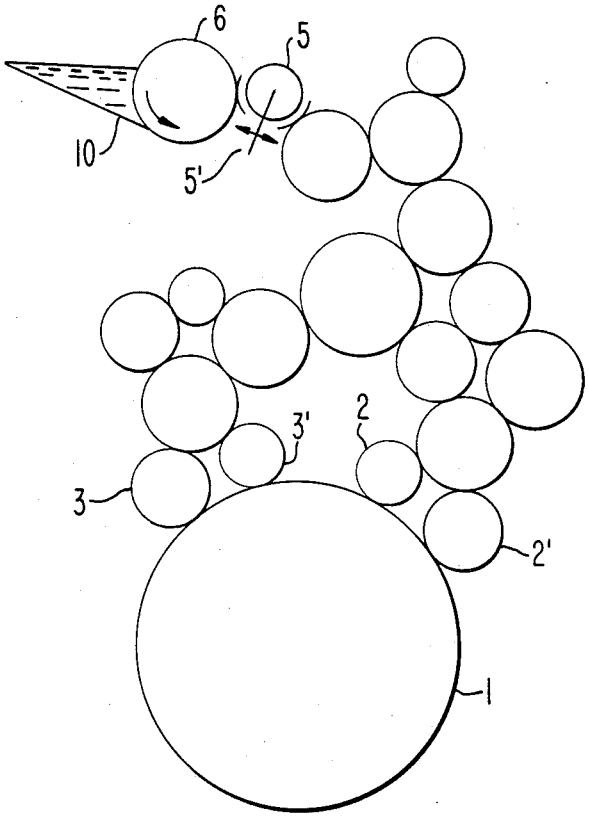
FIG. 1. PRIOR ART

FIG. 1 shows an inking device in a printing machine according to the prior art, having an inking device extending from an ink source roller 6 and an ink call-out roller 5 to ink application rollers 2, 2', 3 and 3' and a plate drum 1. In order to achieve good printing, well kneaded ink must be fed to a pattern on a plate surface in a uniform thickness coating. To that end, it is necessary to make the feed surfaces of the ink application rollers 2, 2', 3 and 3' which directly feed ink to the plate always hold a fixed thickness of ink.

However, if the amount of ink consumed differs in the widthwise direction, i.e. axially of the drum 1, due to the pattern on the plate surface, then the speed with which the ink film thickness decreases in the roller group of the inking device is different in the widthwise direction. In other words, the ink film thicknesses on the feed surfaces of the ink application rollers 2, 2', 3 and 3' would vary. In order to compensate for this variation of the film thicknesses, the magnitude of the ink feed rate must be different in the widthwise direction. In other words, where consumption of ink is large it is necessary to increase the feed of ink, whereas where consumption of ink is small it is necessary to decrease the feed of ink.

Such regulation of the ink feed rate in the widthwise direction is determined by practically carrying out printing, that is, the rate is determined by trial and error. Therefore, a lot of time is spent for this regulation and waste of printing materials during such period is large. Moreover, each time the kind of work, that is, the printing plate, is changed, such regulation must be repeated. Even if an expert in the art is employed for preventing such troubles, naturally the saving of time and materials is be limited.

As a matter of course, the ink feed device 10 is required to have a structure which can regulate the ink feed rate in the widthwise direction, and this requirement makes the ink feed device 10 complex.

Moreover, even if the feed distribution of ink has been determined in this way, since ink is fed intermittently by a rocking motion 5' of the ink call-out roller 5, the ink film thicknesses on the inking rollers will vary depending upon the rocking period of the ink call-out roller. In order to smooth this variation as much as possible, there are provided many inking rollers between the ink call-out roller 5 and the ink application rollers 2, 2', 3 and 3'.

Consequently, the inking device of the prior art requires a large space and a lot of power for driving the roller, and so it accounts for a large proportion of the cost of construction of a printing system.

It is therefore one object of the present invention to provide an inking device in a printing machine, in which the aforementioned shortcoming of the prior art device is eliminated, regulation of the ink feed rate is made unnecessary regardless of variations in the rate of consumption of ink in the widthwise direction, and regardless of variation of the ink film thicknesses caused by intermittent feed by the call-out roller, yet which is less expensive and compact, and can achieve automation, saving of human labor and saving of resources in printing.

According to one feature of the present invention, there is provided an inking device in a printing machine comprising an ink reciprocating roller provided adjacent to the ink application rollers, regulator means provided adjacent to a hysteresis surface of the ink reciprocating roller for forming the residual ink on the hysteresis surface into a uniform film thickness, an ink source roller partly immersed in ink in an ink receiver, and an ink delivery roller interposed between the ink source roller and the ink reciprocating roller.

In the inking device according to the present invention constructed in the above-described manner, the ink in the ink receiver is continuously transferred from the ink source roller to the ink delivery roller, subsequently to the ink reciprocating roller, and then it is fed to the plate surface via the ink application rollers. Although the ink remaining on the hysteresis surface of the ink reciprocating roller is uneven depending upon the pattern on the plate, this can be made into a uniform film thickness by the regulator means, and then the ink reciprocating roller receives ink from the ink delivery roller.

As described above, according to the present invention, whether profile may take the distribution of ink consumption by printing, since the ink remaining on the hysteresis surface is formed into a uniform thickness film by the regulator means, the feed profile of ink can be kept constant. In other words, even if the plate is changed, there is no need to regulate the feed rate of the ink. In addition, the number of rolls in the inking device can be reduced, and thus compactness and reduction of cost can be achieved.

Figure 2:
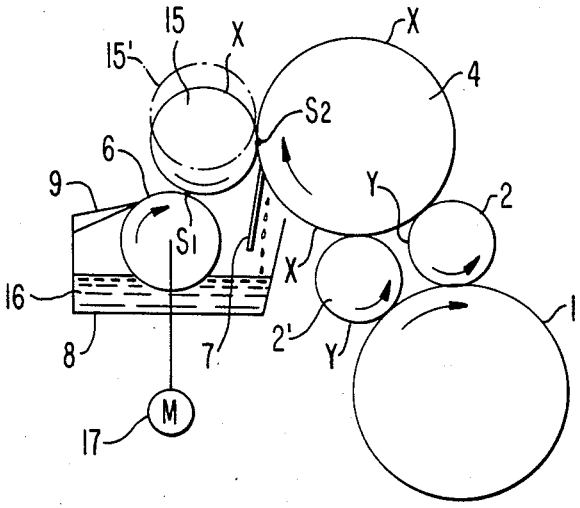

The above-described and other objects, features and advantages of the present invention will become more apparent by reference to the following description of a preferred embodiment thereof taken in conjunction with the accompanying drawings, wherein:

FIG. 1 is a schematic side view of an inking device in a printing machine of the prior art; and FIG. 2 is a schematic side view of an inking device according to one preferred embodiment of the present invention.

Referring now to FIG. 2, reference numeral 1 designates a plate drum, and numerals 2 and 2' designate ink application rollers.

Reference numeral 4 designates an ink reciprocating roller which receives the ink fed from upstream thereof and transmits the ink to the ink application rollers 2 and 2'. It is to be noted that among the aforementioned respective rollers, the plate drum 1 and the ink reciprocating roller 4 are driven by a drive source of a printing machine, not shown, and the directions of rotation thereof are as shown by the arrows in the figure. Reference numeral 7 designates a doctor blade the tip end of which is brought into pressing contact with a hysteresis surface X of the ink reciprocating roller 4 and directed in the direction of movement of the surface of roller 4, so that as the roller 4 rotates the doctor 7 can uniformly smooth out the ink present on the surface to a uniform film thickness, and excess ink smoothed out by the doctor 7 is returned to an ink receiver 8 for reuse. A delivery roller 15 is in contact with the reciprocating roller 4 so that as the reciprocating roller rotates, the delivery roller is rotated by the reciprocating roller 4. An ink source roller 6 is positioned in such manner that at point $S_1$ it is spaced by a small gap from the delivery roller 15 or it makes contact with the delivery roller 15 with a light pressure along a line, and it is driven by a separate drive source 17.

Ink 16 to be used for printing is stored in the ink receiver 8, and the ink source roller 6 is partly immersed in this stored ink. Along the outer periphery of the ink source roller 6 is provided a blade 9, so that the ink adhering to the outer periphery of the ink source roller 6 as it passes blade 9 is averaged into a uniform thickness by the tip end of the blade 9. Thereafter as the ink source roller 6 rotates, the ink is carried to the point $S_1$ to the ink delivery roller 15, and at this point a part of the ink is continuously transferred to the ink delivery roller 15.

In the inking device having the above-described construction, feeding of ink to a pattern portion on the plate surface is achieved by the ink application rollers 2 and 2'. Then the hysteresis surface Y of the ink application rollers 2 and 2' has an ink film thickness the thickness of which varies corresponding to the pattern of the plate. This thickness variation of the ink film is also transmitted to the hysteresis surface X of the ink reciprocating roller 4 located upstream of ink application rollers 2 and 2'. In the prior art, for the purpose of compensating for this thickness variation of the ink film and achieving a uniform ink film thickness, it was necessary to regulate the feed rate in the widthwise direction of the ink source roller and also to provide a large number of rollers.

In the illustrated embodiment, the thickness variation of the ink film on the hysteresis surface X of the ink reciprocating roller 4 is regulated by smoothing out the surface layer by the doctor 7, so that the ink film thickness after passing the doctor 7 is uniform. Thereafter, at the point $S_2$ a uniform thickness of ink is supplied such that the ink film has a thickness necessary for printing. As this supplied ink is fed continuously from the contact point $S_1$ between the ink source roller 6 and the ink delivery roller 15, a large number of rollers as often required where there is intermittent feed by a call-out roller in the prior art, are not necessary. In addition, the rate of the ink supplied from the ink source roller 6 to the ink delivery roller 15 via the contact $S_1$, can be easily regulated so as to be of uniform thickness over the entire width by varying the peripheral speed of the ink source roller 6. Accordingly, regulation of the ink feed rate at different rates in the widthwise direction during printing becomes unnecessary. In other words, a regulation device for regulating the ink feed at different rates in the widthwise direction can be omitted, and moreover, the printing density on a paper sheet can be set at any arbitrary level. In addition, in the case where the width of paper sheet to be printed is changed, if the ink source roller and the blade is preliminarily divided according to the sheet width, it becomes possible to stop feeding of ink to the portion of the rollers other than that corresponding to the sheet width.

Furthermore, if the position of the ink delivery roller 15 is made variable between a "contact" position (shown) to a "release" position 15', by locating it at the "release" position 15' it is possible to stop feeding of ink over the entire width of the ink delivery roller, and so it is convenient to carry out test operation of a printing machine.

What is claimed is:

1. An inking means for applying ink to a plate drum of a printing machine, comprising:

ink application rollers for being in rolling contact with the plate drum;

an ink reciprocating roller adjacent and in rolling contact with said ink application rollers for transferring a layer of ink thereto;

means for maintaining the entire thickness of the layer of ink on said ink reciprocating roller uniform, said means including a single doctor blade in contact with said reciprocating roller downstream, relative to the direction of movement of the surface of said reciprocating roller, of said ink application rollers and defining an acute angle between said doctor blade and a tangent to the surface of said reciprocating roller at the point where said doctor blade contacts said reciprocating roller, said angle opening toward the direction from which the surface of said reciprocating roller approaches said contact point for smoothing ink remaining on the surface of said reciprocating roller into a uniform film thickness;

an ink reservoir below said doctor blade for receiving ink from said doctor blade;

an ink source roller having a part of the periphery in said ink reservoir for receiving from the ink reservoir a uniform thickness layer of ink; and an ink delivery roller positioned between said ink source roller and said reciprocating roller and contacting said ink source roller for receiving the uniform thickness layer of ink therefrom and contacting said reciprocating roller downstream of said doctor blade for transferring the uniform thickness layer of ink onto said uniform film thickness of ink formed on said reciprocating roller by said doctor blade.

* * * * *